US007896660B2

(12) United States Patent
Tochi et al.

(10) Patent No.: US 7,896,660 B2
(45) Date of Patent: Mar. 1, 2011

(54) IC CARD

(75) Inventors: Akihiro Tochi, Kanagawa (JP); Masaki Tsujimoto, Kanagawa (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 12/654,950

(22) Filed: Jan. 11, 2010

(65) Prior Publication Data

US 2010/0184310 A1 Jul. 22, 2010

(30) Foreign Application Priority Data

Jan. 15, 2009 (JP) ..... 2009-006853

(51) Int. Cl.
*H01R 12/00* (2006.01)

(52) U.S. Cl. ..... 439/78

(58) Field of Classification Search ..... 439/78, 439/76.1, 946, 109, 79–80, 630, 632, 541.5
See application file for complete search history.

(56) References Cited

U.S. PATENT DOCUMENTS

| | | | | |
|---|---|---|---|---|
| 6,053,748 | A * | 4/2000 | Bricaud et al. | 439/76.1 |
| 6,663,432 | B2 * | 12/2003 | Inagawa | 439/607.48 |
| 6,728,111 | B1 * | 4/2004 | Ku | 361/752 |
| 7,479,041 | B1 * | 1/2009 | Chen | 439/630 |
| 7,597,586 | B2 * | 10/2009 | Huang et al. | 439/541.5 |
| 7,632,151 | B2 * | 12/2009 | Wang et al. | 439/630 |
| 2002/0142633 | A1 * | 10/2002 | Inagawa | 439/98 |

FOREIGN PATENT DOCUMENTS

| | | | |
|---|---|---|---|
| JP | 60-091489 | A | 5/1985 |
| JP | 05-325535 | A | 12/1993 |
| JP | 07-202466 | A | 8/1995 |
| JP | 10-097604 | A | 4/1998 |
| JP | 10-179885 | A | 7/1998 |
| JP | 10-179886 | A | 7/1998 |
| JP | 2000-030807 | A | 1/2000 |
| JP | 2000-030808 | A | 1/2000 |
| JP | 3167416 | B2 | 3/2001 |
| JP | 3167417 | B2 | 3/2001 |
| JP | 2001-155135 | A | 6/2001 |
| JP | 2002-111271 | A | 4/2002 |
| JP | 2004-030693 | A | 1/2004 |

* cited by examiner

*Primary Examiner*—Jean F Duverne
(74) *Attorney, Agent, or Firm*—Rader, Fishman & Grauer PLLC

(57) ABSTRACT

An IC card includes a frame with a rectangular border open on one side, a printed circuit board equipping an electronic component, a plate-shaped connector, and one pair of conductive shell plates. The connector constitutes one side of the frame. The one pair of shell plates covers both faces of the frame and the connector. The connector has a housing, a plurality of male contacts arranged in parallel in the interior of the housing, and a short circuit terminal. The male contacts are such that one end portion is a connecting portion to an external terminal and another end portion is connected to the printed circuit board. The short circuit terminals are mounted on the housing such that one end portion is in contact with a predetermined male contact among the plurality of male contacts and another end portion is in contact with an inner wall of a shell plate.

4 Claims, 9 Drawing Sheets

IC CARD

This application is based on and claims the benefit of priority from Japanese Patent Applications No. 2009-006853, filed on 15 Jan. 2009, the content of which is incorporated herein by reference.

BACKGROUND OF THE INVENTION

1. Field of the Invention

The present invention relates to an IC card. In particular, it relates to a structure of IC cards such as CFast that connect to a slot installed on a computer.

2. Related Art

For example, in order to expand functionality of a personal computer (hereinafter, referred to as a "PC"), an expansion card, in which a connector is added to a printed circuit board that has been equipped with a microcomputer, is connected to an expansion slot of a PC. The CFast card is one type of expansion card standardized for a PC, and connects to a PC, achieving high speed communication.

Although the CFast card is one type of IC card, a printed circuit board equipped with a microcomputer is housed in a rigid body frame thereof. Accordingly, the CFast card can be classified as a different microcomputer card from a memory card in which a memory chip is sealed within a plastic package. Furthermore, in recent years, a CFast card equipped with a keyboard has appeared, and CFast cards can also be classified as multifunction cards.

Such IC cards are vulnerable to electrostatic breakdown, caused by external static electricity, of electronic components equipped on a printed circuit board, and thus electrostatic countermeasures must therefore be taken. Accordingly, a structure of an IC card in which highly reliable electrostatic countermeasures have been taken has been desired.

For example, the IC card according to Japanese Patent No. 3167416 (hereinafter called "Patent Document 1") includes a printed circuit board, a connector, and two planar conductive boards. The printed circuit board equips an electronic component. The connector has a predetermined number of connector pins arranged thereon on a connector frame, and is attached to the printed circuit board. Furthermore, on the connector, a ground pin among the connector pins is connected to a ground pattern on the printed circuit board. One pair of conductive boards is placed in contact to upper and lower faces of the connector frame.

Additionally, in the IC card according to Patent Document 1, through-hole portions, which are open facing the conductive board, are formed above and below a connector frame corresponding to the ground pin, respectively. Furthermore, a protruding piece is installed above and below the ground pin, each protruding piece is made to pass through a through-hole portion which protrudes from an outer surface of the connector frame toward each conductive board side. In addition, by sandwiching both of the upper and lower faces of the connector frame with the conductive board, each protruding piece is pushed and deformed in the through-hole portion and elastically connected to each conductive board, respectively.

In the IC card according to Patent Document 1, a connector frame functions as a stopper member for conductive boards or members on the manufacturing line. As a result, even if a conductive board or another member or the like pushes a protruding portion of the ground pin, then if the conductive board or another member eventually abuts an outer surface of the connector frame, pushing deformation of the ground pin is prevented. Therefore, the protruding portion of the ground pin does not excessively deform, and for any IC card, a contact between the ground pin and a conductive board is suitably maintained, whereby reliability of electrostatic countermeasures is improved.

In the IC card according to Patent Document 1, the ground pin is made to be a "female contact" having a box-shaped lead-in allowing for easy insertion of a "male contact." Additionally, the ground pin mounts the protruding piece.

Such a "female contact" as mentioned above is manufactured by press molding a metal plate, which has been developed in a predetermined form, into a box shape. In addition, if the "female contact" is manufactured in a linked state, creating a "linkage-type contact," mass production becomes possible, and automatic mounting becomes easy.

However, linkage-type contacts are manufactured by being wound on a reel, and therefore, when a protruding piece is established as the ground pin disclosed in Patent Document 1, there is a concern that, in a state of being wound on the reel, or during transport, the protruding piece may be deformed. That is to say, if the protruding piece of the ground pin is deformed, then accurately fitting the ground pin into the connector frame becomes difficult, and there is a concern that electrostatic countermeasures for the IC card may not be achievable.

SUMMARY OF THE INVENTION

The present invention was created in view of such problems as the above, and has an objective of providing an IC card to which countermeasures for static electricity have been applied, and for which manufacturing is easy.

An IC card according to an aspect of the present invention includes a frame of a rectangular border-shape that is open on one side thereof, a printed circuit board that is disposed on an interior portion of the frame and equips an electronic component, a connector of a plate shape that constitutes one side of the frame, and one pair of shell plates having conductivity that covers the frame from both faces and constitutes an outer shell, in which the connector has a housing that has both faces thereof covered by the one pair of shell plates, a plurality of male contacts that is arranged in parallel in an interior of the housing, has one end portion that is a connecting portion to an external terminal, and has another end portion that is connected to the printed circuit board, and at least one short circuit terminal that is mounted on the housing, has one end portion thereof that contacts an intermediate portion of a predetermined male contact among the plurality of male contacts, and has another end portion thereof that contacts an inner wall of any one of the shell plates of the one pair of shell plates.

The housing is such that a storage chamber or groove may be established for the short circuit terminal, and the storage chamber or groove is established in the proximity of a predetermined male contact. Furthermore, the short circuit terminal is inserted from one direction into the storage chamber or groove and mounted thereon.

The short circuit terminal may be a short circuit terminal composed of a conductive material, and the short circuit terminal can be obtained by molding a metal plate into a connector of a desired shape. The short circuit terminal should preferably be composed of an easily shaped copper alloy having conductivity, without being limited thereto.

In the IC card according to an aspect of the above-mentioned present invention, for the first aspect of the short circuit terminal, preferably, the short circuit terminal should have a press-fit plate that press-fits into the housing to be substantially parallel to a direction of extension of the male contact, a first contact piece that bends one single wing of the press-fit plate, and has a front portion thereof that contacts an intermediate portion of the male contact, and a second contact piece that bends another single wing of the press-fit plate, and has a front portion thereof that contacts an inner wall of either one of the shell plates of the one pair of shell plates.

According to a first aspect of the short circuit terminal, the short circuit terminal may be a crank-shaped connection plate, and the first contact piece, which is to be one end portion, can come into contact with an intermediate portion of a male contact. Furthermore, the second contact piece, which is to be another end portion, is such that one portion may protrude marginally from the housing, and by building a shell plate into the housing, may come into contact with an inner wall of the shell plate.

In the IC card according to an aspect of the above-mentioned present invention, a second aspect of the short circuit terminal has one end portion that contacts each intermediate portion of one predetermined set of male contacts which are adjacent to each other among the plurality of male contacts, and has another end portion that contacts an inner wall of either one of the shell plates of the one pair of shell plates.

In the IC card according to an aspect of the above-mentioned present invention, for the second aspect of the short circuit terminal, preferably, the short circuit terminal should have a press-fit plate that press-fits into the housing to be substantially parallel to a direction of extension of the male contact, one pair of first contact pieces that bend both wings of the press-fit plate, and has front portions thereof that contact an intermediate portion of a set of the male contacts, which are adjacent to each other, and a second contact piece that inverts one end edge of the press-fit plate into a J shape, and has a front portion that elastically contacts an inner wall of either one of the shell plates of the one pair of shell plates.

In relation to the second aspect of the above-mentioned short circuit terminal, the short circuit terminal may be a bellows type contact such that one pair of first contact pieces, which is to be one end portion, can come into contact with each intermediate portion of one set of adjacent male contacts. Furthermore, a second contact piece, which is to be another end portion, is such that a front end portion may protrude marginally from the housing, and by building a shell plate into the housing, may elastically come into contact with an inner wall of the shell plate.

It should be noted that, in the present invention, the frame should preferably have insulation properties, and that an insulating frame may be a frame composed of nonconductive material, and that an insulating frame of desired shape may be obtained by molding synthetic resin. The frame is not limited to a frame of a single body. A frame open on one side such that one pair of frames is superimposed and joined is also included in the frame of the present invention. A frame open on one side indicates that one side is partially eliminated.

The printed circuit board may be placed in a space surrounded by a frame, a connector, and one pair of conductive shell plates, and may be placed in an interior of a frame by inserting, holding, storing, or the like. For example, another edge portion of a plurality of male contacts may be "soldered" to an edge connector installed on the printed circuit board (also known as a "printed contact"), and the printed circuit board may be fixed thereby to an interior of the frame. An electronic component may preferably be surface-mounted on one surface of a printed circuit board, and by selecting an electronic component of low mounting height, a low-profile IC card may be created.

For a connector to constitute one side of a frame indicates the connector being built into the frame and the outer border of the IC card being constituted. Furthermore, an outer shell of an IC card is constituted by one pair of shell plates covering a frame and a connector. The connector may link one side of a frame, and by one pair of shell plates covering the frame and the connector, the connector and frame may be linked, and a frame of a rigid body may be achieved.

The one pair of conductive shell plates may preferably be composed of a metal plate of thin plate thickness such that both wings may be bent perpendicularly and latch onto a plate thickness surface of the frame, or may latch onto both faces of the frame, and cover both faces of the printed circuit board, mechanically joining the connector and the frame. The shell plates may constitute an outer shell of the IC card, and also function as shielding plates blocking unwanted electromagnetic waves.

For the one pair of shell plates, stainless steel plates having an corrosion-preventing effect may preferably be used; for example, steel plates coated with chrome are also acceptable. Furthermore, for the one pair of shell plates, in order to prevent the inner wall thereof from short circuiting to the pattern side (wired side) of the printed circuit board, an insulating film may be partially applied.

The male contacts being arranged in parallel in the interior of the housing indicates that the male contacts are arranged in one line adjacent to one another, and placed to be aligned in the interior of the housing. Furthermore, a configuration in which the male contacts are arranged and placed in two lines in the interior of the housing is also included in the present invention.

For example, the male contacts may be pin contacts that extend, while plate contacts that extend in a band are preferably used. Additionally, in order physically to prevent exposure of a plurality of plate contacts, a shroud (dividing wall) that forms a rectangular opening may be installed in the housing, and one end portion of the plate contact may be placed in the shroud.

In an intermediate portion of the plate contact, a barb may be installed, and press-fit into the housing so as to anchor the plate contact. The plate contact may be integrally molded with the housing. On another end portion of the plate contact, a lead portion may be installed so as to protrude from the housing, and "soldered" onto an edge connector installed on the printed circuit board.

Furthermore, at least one short circuit terminal belonging to the IC card related to the present invention indicates that a short circuit terminal is capable of being in contact with a given male contact. Furthermore, a given male contact indicates that the male contact is a ground connection. For the housing, a short circuit terminal may be mounted in a vicinity of a given male contact, and the given male contact may be selected based on a use of the IC card.

DETAILED DESCRIPTION OF THE INVENTION

In order to achieve the objective of the present invention, without installing any special ground pins, the inventors devised configuring all the contacts as linkage-type contacts with batch production, established a short circuit terminal connecting a given contact with a conductive board (shell plate), forming the basis for the resulting invention of a new IC card. That is to say, by configuring a contact pin (contact) and a ground pin as a common "linkage-type contact" in facilitating manufacture, and achieving an IC card to which countermeasures for static electricity have been applied by way of a short circuit terminal, it is possible to contribute to lowering a cost of manufacture of an IC card. Hereinafter, an embodiment of the present invention is explained with reference to the drawings.

First Embodiment

Figure 1:
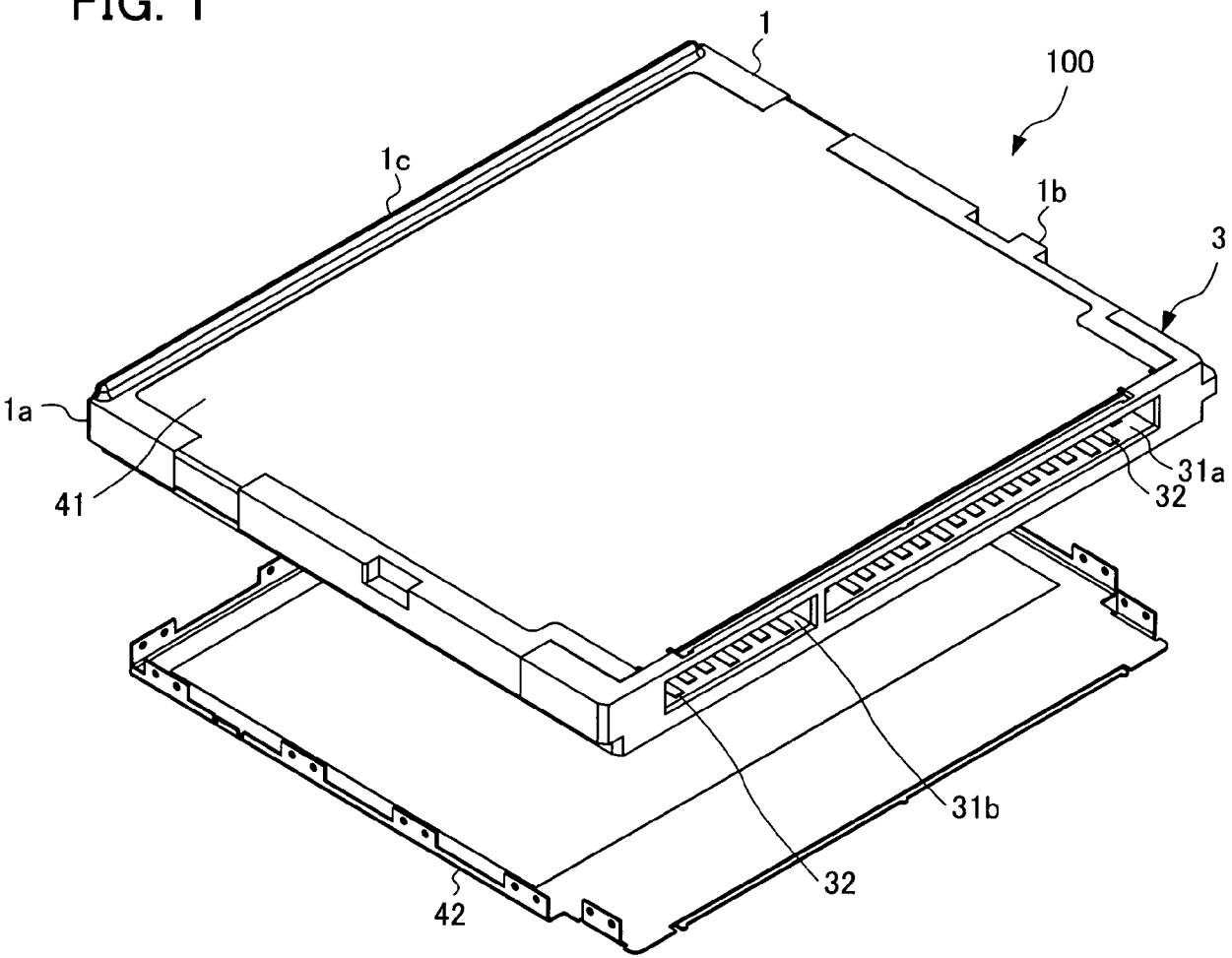
FIG. 1 is a first perspective view showing an exterior of an IC card according to a first embodiment of the present invention.
Figure 2:
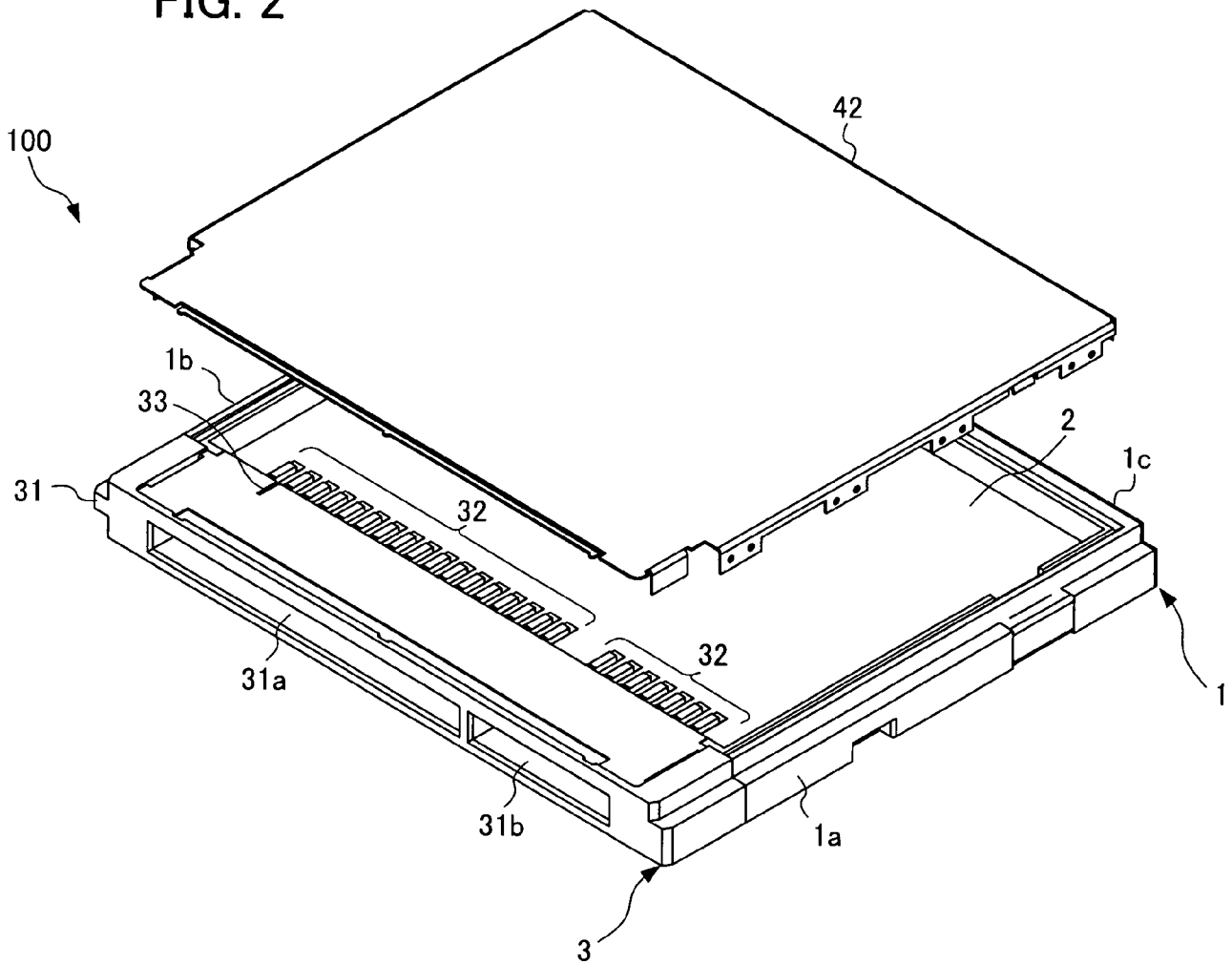
FIG. 2 is a second perspective view showing an exterior of the IC card according to the first embodiment.
Figure 3:
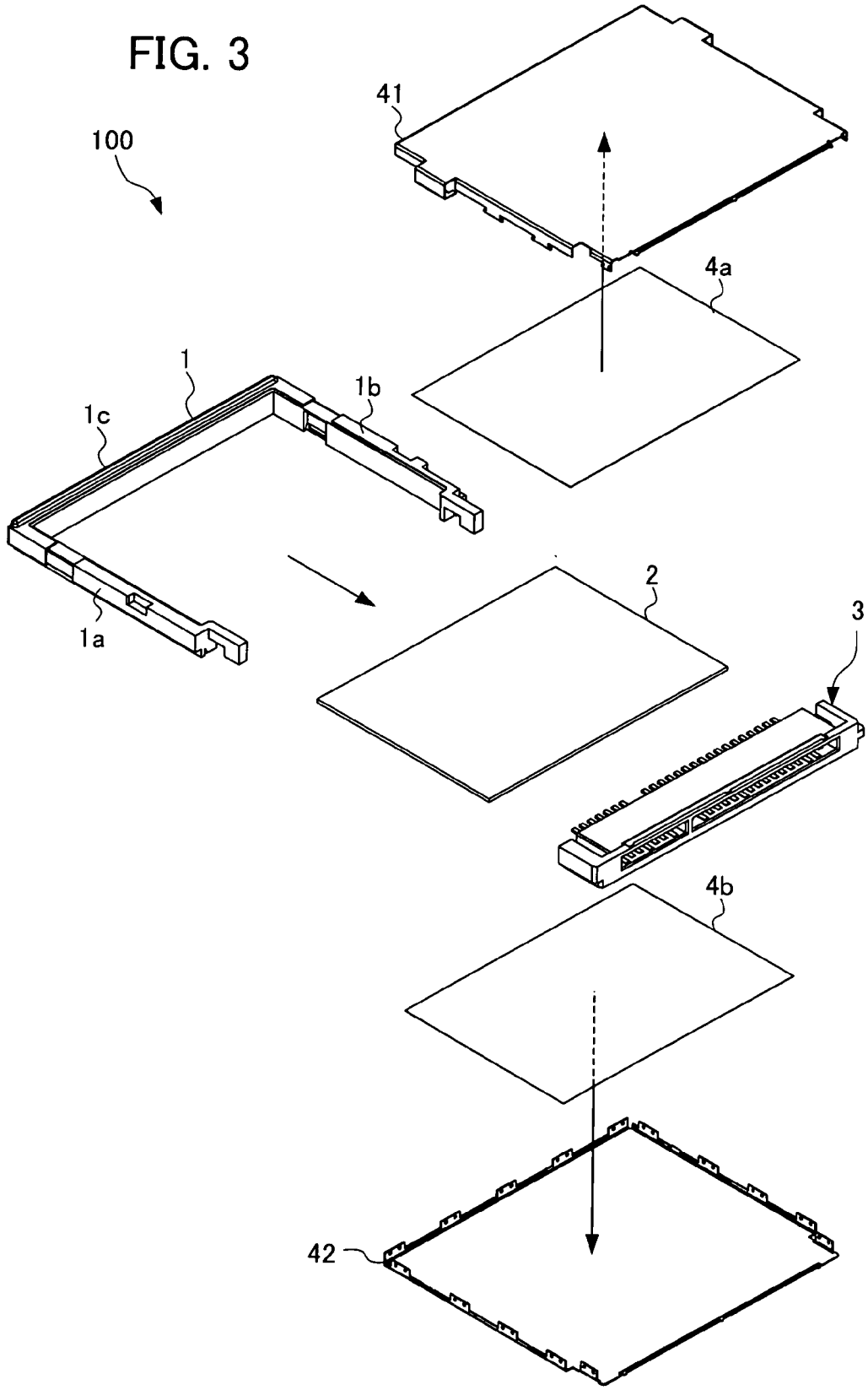
FIG. 3 is a first perspective exploded view showing the IC card according to the first embodiment.
Figure 4:
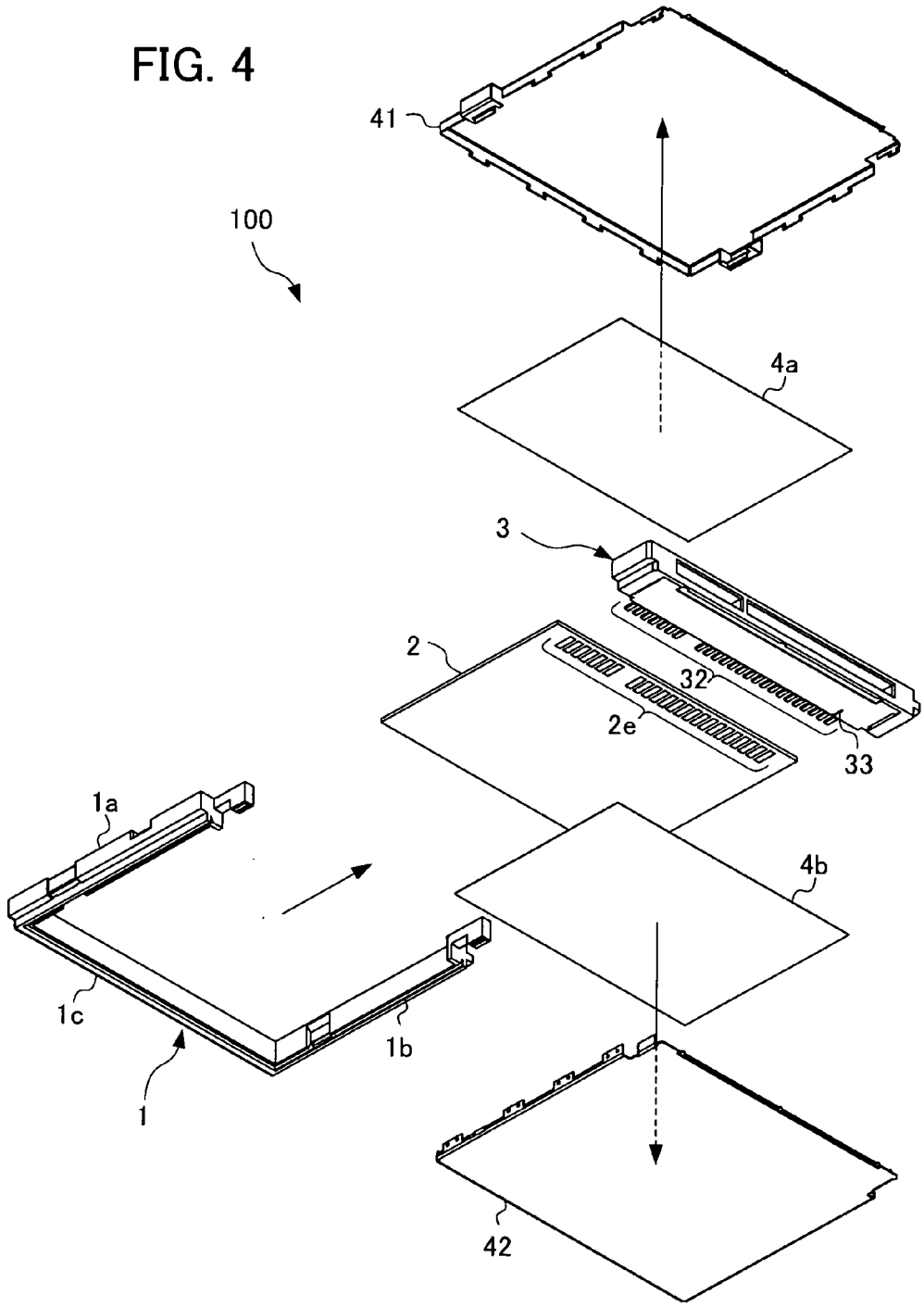
FIG. 4 is a second perspective exploded view showing the IC card according to the first embodiment.

FIG. 1 is a first perspective view showing an exterior of an IC card according to a first embodiment of the present invention. FIG. 2 is a second perspective view showing an exterior of the IC card according to the first embodiment, in which the IC card is seen from a different direction than in FIG. 1. FIG. 3 is a first perspective exploded view showing the IC card according to the first embodiment. FIG. 4 is a second perspective exploded view showing the IC card according to the first embodiment, in which the IC card is seen from a different direction than in FIG. 3.

In reference to FIGS. 1 through 4, the IC card 100 according to the first embodiment includes a frame 1 with a rectangular border, a printed circuit board 2, a plate-shaped connector 3, and one pair of conductive shell plates 41 and 42. The frame 1 is open on one side. The printed circuit board 2 is disposed in an interior of the frame 1, and mounts an electronic component which is not shown. The connector 3 constitutes one side of the frame 1. The one pair of conductive shell plates 41 and 42 cover the frame 1 from both sides, and constitute an outer shell of the IC card 100.

Figure 5:
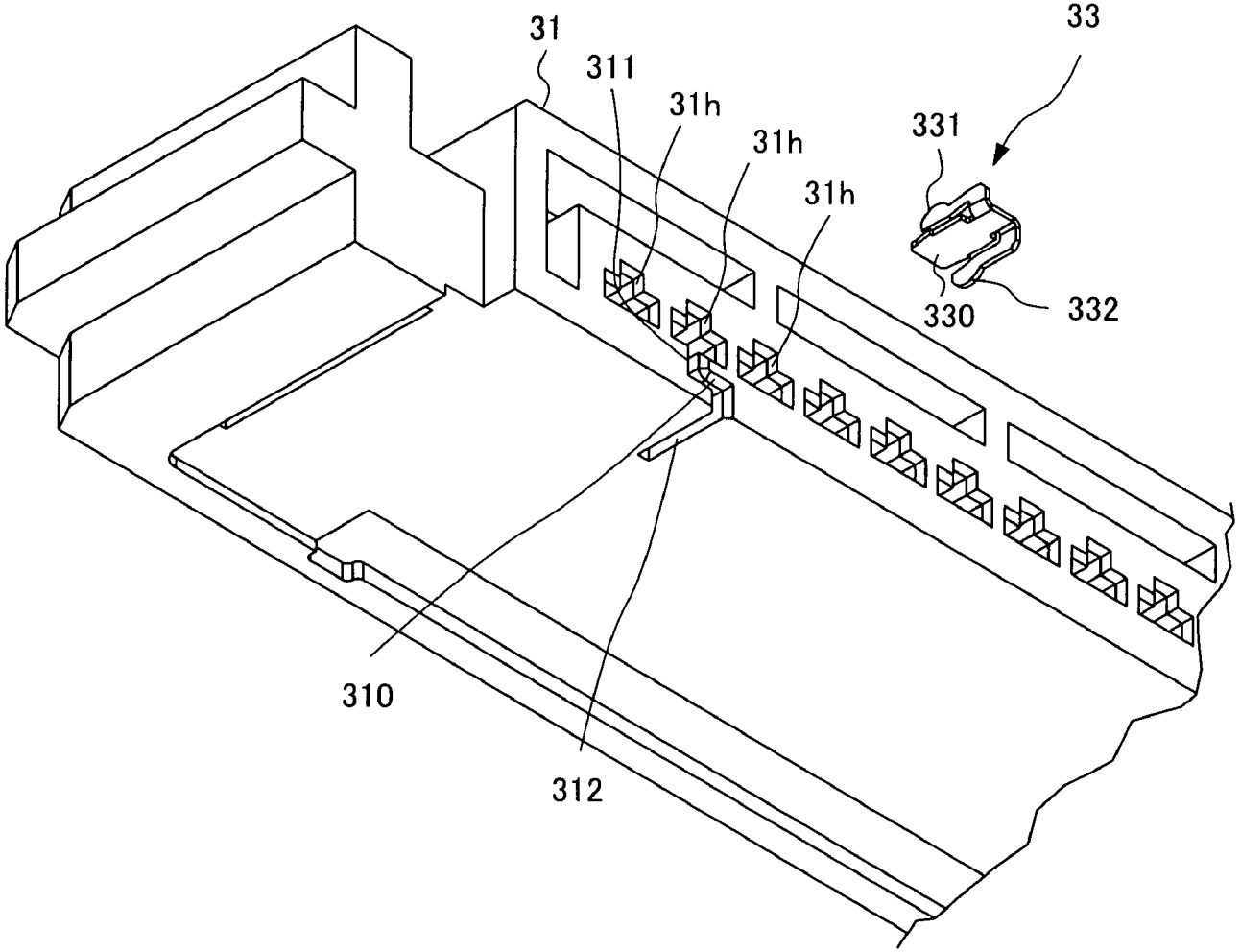
FIG. 5 is a perspective view showing an exterior of a short circuit terminal and a housing equipped to a connector of the IC card according to the first embodiment.
Figure 6:
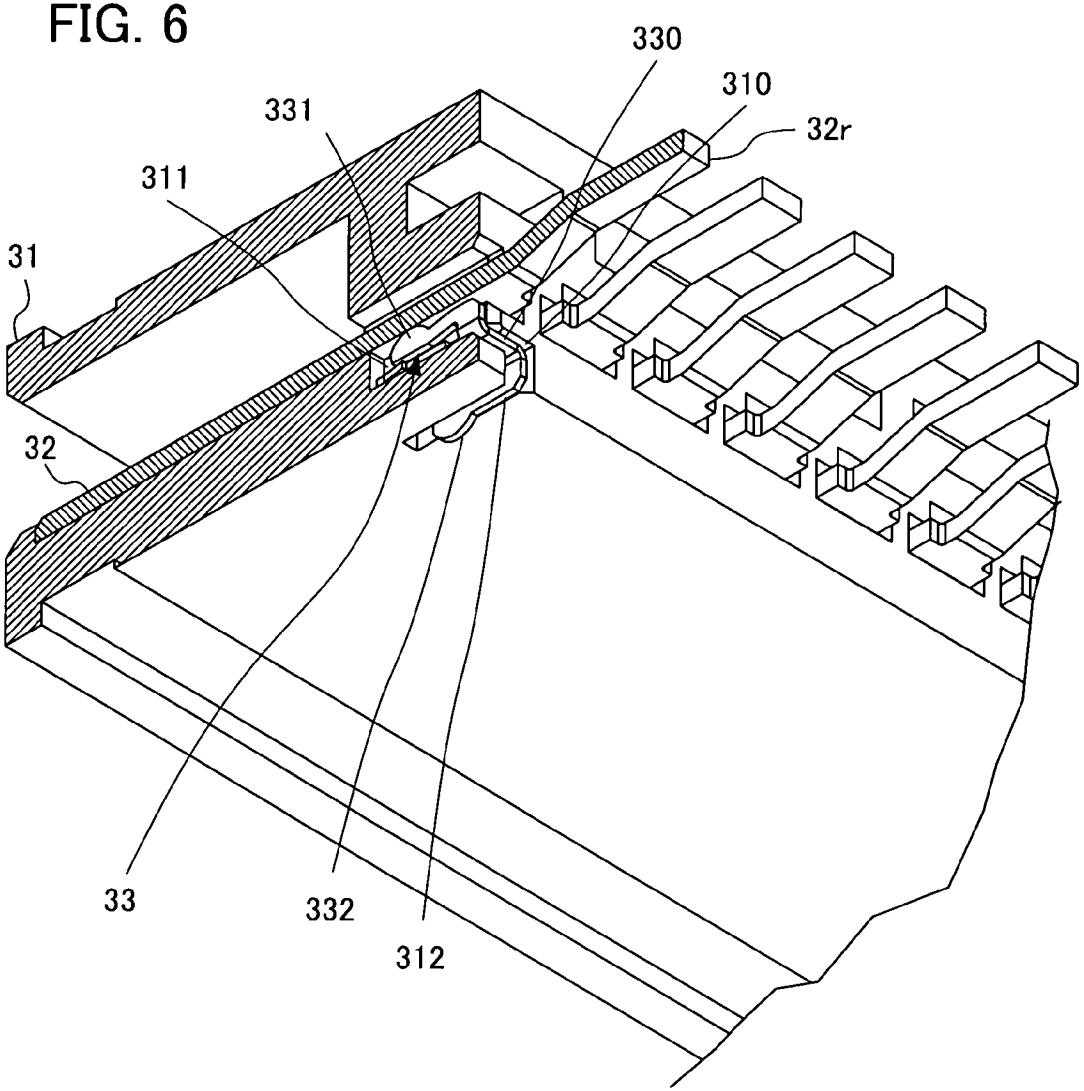
FIG. 6 is a perspective view showing, in a longitudinal section, a main portion of the connector equipped to the IC card according to the first embodiment.

FIG. 5 is a perspective view showing an exterior of a short circuit terminal and a housing equipped to a connector of the IC card according to the first embodiment. FIG. 6 is a perspective view showing, in a longitudinal section, a main portion of the connector equipped to the IC card according to the first embodiment.

In reference to FIGS. 5 and 6, the connector 3 has a housing 31, a plurality of male contacts 32, and a short circuit terminal 33. The housing 31 is covered on both sides by the one pair of shell plates 41 and 42 (see FIGS. 1 and 2).

The plurality of male contacts 32 are arranged in parallel in an interior of the housing 31. Furthermore, for each of the male contacts 32, one end portion is a connecting portion to an external terminal which is not shown, and another end portion is connected to the printed circuit board (see FIG. 2). The short circuit terminal 33 is mounted on the housing 31, and one end portion is in contact with an intermediate portion of a predetermined male contact of the plurality of male contacts 32, and another end portion is in contact with an inner wall of the shell plate 42.

In reference to FIGS. 1 through 4, the frame 1 is constituted by one pair of casing boards 1*a* and 1*b* extending substantially in parallel, and a casing board 1*c* which joins base end sections of each of the one pair of casing boards 1*a* and 1*b*. In addition, the front end portions of the one pair of casing boards 1*a* and 1*b* fit together with both wings of the connector 3, and constitute an outer border of the IC card 100. Furthermore, the one pair of shell plates 41 and 42 covers the frame 1 and the connector 3, and thus constitutes an outer shell of the IC card 100.

In reference to FIGS. 1 through 4, the one pair of shell plates 41 and 42 is conductive and is formed by a metal plate of thin plate thickness. Moreover, for the one pair of shell plates 41 and 42, both wings are refracted perpendicularly. The one pair of shell plates 41 and 42 are interleavedly latched onto a plate thickness surface of the frame 1 and the connector 3, and interleavedly latched onto both sides of the frame 1 and the connector 3 as well.

In reference to FIGS. 1 through 4, the one pair of shell plates 41 and 42 covers both sides of the printed circuit board 2, and mechanically joins the connector 3 and the frame 1. The one pair of shell plates 41 and 42 may constitute an outer shell of the IC card, and also functions as shield plates blocking unwanted electromagnetic waves.

In reference to FIGS. 3 and 4, in the embodiment, the one pair of shell plates 41 and 42 use stainless steel plates having a corrosion-preventing effect; however, for example, steel plates coated with chrome are also acceptable. Furthermore, for the one pair of shell plates 41 and 42, in order to prevent an inner wall thereof from short circuiting to the pattern side of the printed circuit board 2, insulating films 4*a* and 4*b* may be partially applied.

In reference to FIG. 6, each of the plurality of male contacts 32 uses a plate contact that extends in a band. Additionally, in reference to FIGS. 1 and 2, in order physically to prevent exposure of a plurality of male contacts 32, one pair of shrouds 31*a* and 31*b*, which forms a rectangular opening, is installed in the housing 31. One of the end portions of the male contacts 32 is arranged in parallel to the one pair of shrouds 31*a* and 31*b*.

Figure 7:
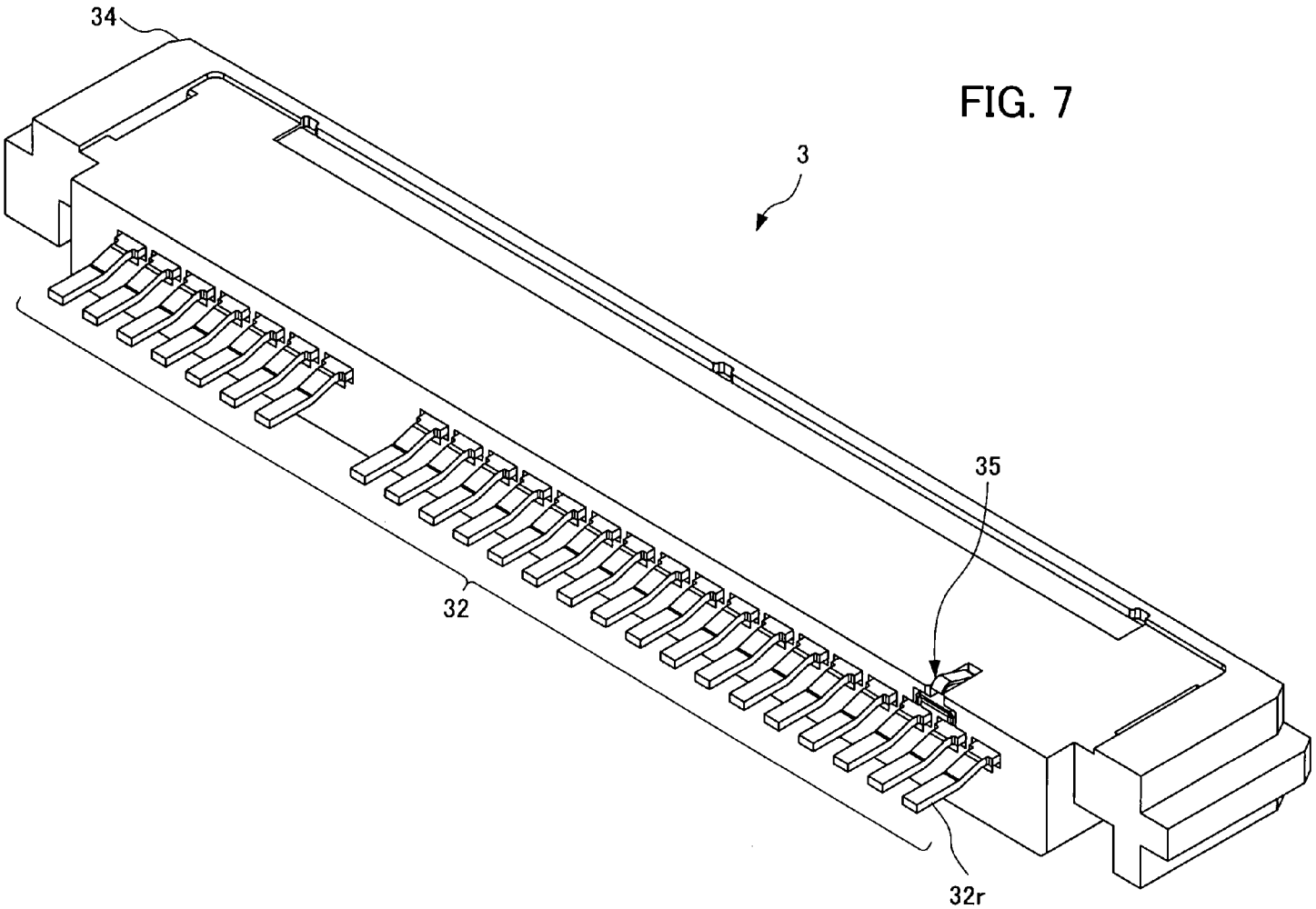
FIG. 7 is a perspective view showing a second embodiment of the present invention, and showing an exterior of a connector equipped to an IC card common to both the first and second embodiments.
Figure 8:
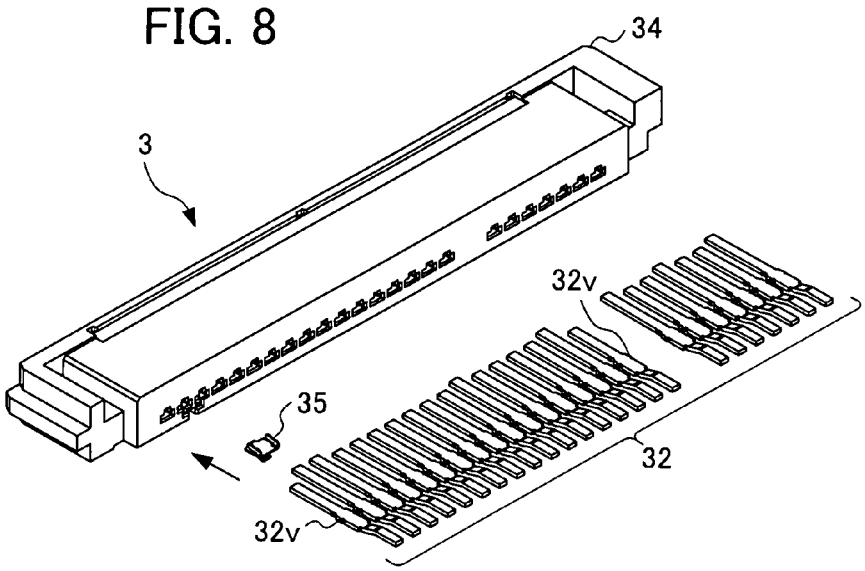
FIG. 8 is a perspective exploded view showing the second embodiment, and showing the connector equipped to the IC card common to both the first and second embodiments.

Furthermore, FIG. 7 shows a second embodiment of the present invention, and is a perspective view showing an exterior of a connector equipped to the IC card common to both the first and second embodiments. FIG. 8 shows the second embodiment, and is a perspective exploded view showing the connector equipped to the IC card common to both the first and second embodiments.

In reference to FIG. 8, a barb 32*v* is installed on an intermediate portion of each of the plurality of male contacts 32. Accordingly, when each of the plurality of male contacts 32 is press-fit to the housing (31 or 34), the barbs 32*v* of each penetrate the interior of the housing, and can fix each of the plurality of male contacts 32 to the housing thereby.

In reference to FIGS. 6 and 7, on another end portion of each of the plurality of male contacts 32 is installed a lead portion 32*r* which protrudes from the housing 31 (or 34). Additionally, by "soldering" a lead portion 32*r* to an edge connector 2*e* installed on the printed circuit board 2, the printed circuit board 2 can be fixed to the connector 3.

In reference to FIGS. 5 and 6, the short circuit terminal 33 has a press-fit plate 330, a first contact piece 33*l*, and a second contact piece 332. The press-fit plate 330 is press-fit to the housing 31 substantially in parallel to a direction of extension of the plurality of male contacts 32. The first contact piece 331 is such that one of the single wings of the press-fit plate 330 is refracted, and a front end portion is in contact with an intermediate portion of a predetermined male contact of the plurality of male contacts 32. The second contact piece 332 is such that another single wing of the press-fit plate 330 is refracted, and a front end portion is in contact with an inner wall of the shell plate 42.

In reference to FIGS. 5 and 6, on the housing 31 are installed each of the through-holes 31*h* into which each of the plurality of male contacts 32 is press-fit. Furthermore, on the housing 31 is established a press-fitting groove 310 into which the press-fit plate 330 is press-fit directly beneath a predetermined through-hole 31*h*. On the housing 31, the press-fitting groove 310 and the predetermined through-hole 31*h* are made to be in communication, and a first groove 311 into which a first contact piece 33*l* is inserted is established. Furthermore, on the housing 31, a second groove 312 is established, which opens to an outer wall of the housing 31, which is in communication with the press-fitting groove 310 and is made so that a second contact piece 332 can be inserted into the second groove 312. As a result, on the housing 31, the short circuit terminal 33 can be inserted into what is actually a crank-shaped groove, formed by the first groove 311, the press-fitting groove 310, and the second groove 312.

Next, operation and an effect of the IC card according to the first embodiment of the present invention are explained.

The IC card 100 according to the first embodiment of the present invention may use a given male contact 32 of the plurality of male contacts 32 as a ground connection, and through the short circuit terminal 33, the ground connection is in contact with an inner wall of a shell plate 42 of the one pair of shell plates 41 and 42.

Furthermore, to the ground connection of the male contacts 32, electrostatic countermeasures are taken by electrically connecting to a ground pattern through a predetermined connector of the edge connector 2*e* of the printed circuit board 2. In addition, electrostatic countermeasures are applied to the shell plate 42 by electrically connecting through the short circuit terminal 33 and a predetermined male contact 32 which is the ground connection. If the IC card 100 is, for example, connected to an external terminal installed on a PC, the external terminal is grounded through the ground connection, and can dissipate a charge.

In this manner, on the IC card 100 according to the first embodiment of the present invention is installed a short circuit terminal 33 which electrically connects a male contact 32 to be the ground connection and one of the shell plates 42, and therefore, an IC card to which electrostatic countermeasures are applied can be provided.

Furthermore, in reference to FIG. 6, each of the plurality of male contacts 32 according to the first embodiment of the present invention may preferably use plate contacts that extend in a band, and such a plate contact can be easily manufactured by press molding a metal plate which has been developed in a predetermined form, and making into a "linkage-type contact" is also easy. In addition, although the linkage-type contact is manufactured by being wound on a reel which, due to not having projections as conventionally, there is an advantage of low probability of deformation.

Furthermore, in reference to FIG. 8, for the IC card 100 according to the first embodiment of the present invention, it is possible preliminarily to insert a short circuit terminal (33 or 35) into a pole for which a ground connection is required, and to insert a plurality of male connections 32 together. That is to say, automatic mounting of the male contacts 32 is possible. In this manner, the IC card according to the present invention can be easily constructed.

Second Embodiment

Next, a configuration of an IC card according to a second embodiment of the present invention is explained.

FIG. 7 is a perspective view showing a second embodiment of the present invention, and showing an exterior of a connector equipped to an IC card common to both the first and second embodiments. FIG. 8 is a perspective exploded view showing the second embodiment, and showing the connector equipped to the IC card common to both the first and second embodiments.

Figure 9:
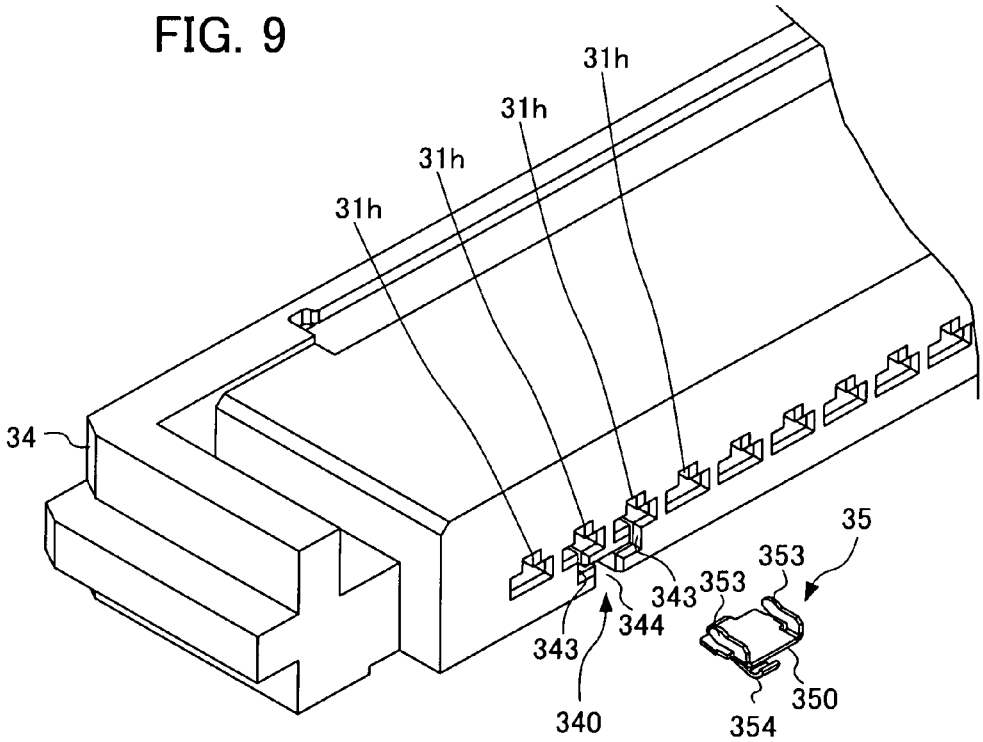
FIG. 9 is a perspective view showing a main portion of an exterior of a short circuit terminal and a housing equipped to the connector of the IC card according to the second embodiment.
Figure 10:
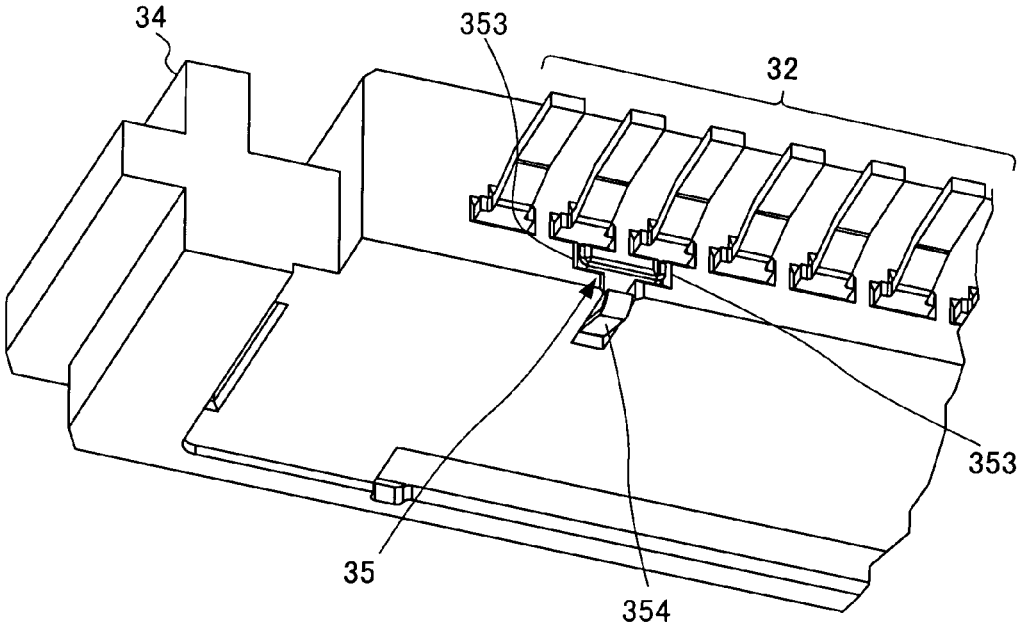
FIG. 10 is a perspective view showing a main portion of an exterior of the connector equipped to the IC card according to the second embodiment.

FIG. 9 is a perspective view showing an exterior of a second short circuit terminal and a housing equipped to the connector of the IC card according to the second embodiment. FIG. 10 is a perspective view showing an exterior of the connector equipped to the IC card according to the second embodiment.

It should be added that, in the explanation below, for components having the same symbols as symbols used in the explanation of the first embodiment, operation is assumed to be the same, and therefore, there are cases in which the explanations may be omitted. Furthermore, for the housing 34 shown in FIGS. 7 through 10, only the mounting hole of the short circuit terminal 33 of the housing 31 has been changed to a mounting hole of the short circuit terminal 35.

In reference to FIGS. 7 through 10, the connector 3 equipped to the IC card according to the second embodiment of the present invention has a housing 34, a plurality of male contacts 32, and a short circuit terminal 35. Both sides of the housing 34 are covered by the one pair of shell plates 41 and 42 (see FIGS. 1 and 2).

The plurality of male contacts 32 are arranged in parallel in an interior of the housing 34. Furthermore, for each of the male contacts 32, one end portion is a connecting portion to an external terminal which is not shown, and another end portion is connected to the printed circuit board 2. The short circuit terminal 35 is mounted to the housing 34, and one end portion is in contact with an intermediate portion of a predetermined pair of male contacts (32 and 32) which are adjacent to each other among the plurality of male contacts 32, and another end portion is in contact with an inner wall of the shell plate 42 (see FIGS. 1 through 4).

In reference to FIGS. 9 and 10, the short circuit terminal 35 has a press-fit plate 350, one pair of first contact pieces 353 and 353, and a second contact piece 354. The press-fit plate 350 is press-fit to the housing 34 substantially parallel to a direction of extension of the male contacts 32.

In reference to FIGS. 9 and 10, the one pair of first contact pieces 353 and 353 is such that both wings of the press-fit plate 350 are bent, and each front end portion is in contact with an intermediate portion of a predetermined pair of male contacts 32 and 32, which are adjacent to each other. The second contact piece 354 is such that one distal border of the press-fit plate 350 is inverted in a J shape, and a front portion is elastically in contact with an inner wall of the shell plate 42.

In reference to FIGS. 9 and 10, on the housing 31 is established a press-fitting groove 340, into which the press-fit plate 350 is press-fitted directly beneath one predetermined pair of through-holes 31*h* and 31*h*, into which one predetermined pair of male contacts 32 and 32 adjacent to each other are press-fitted.

Furthermore, in reference to FIGS. 9 and 10, on the housing 34, the press-fitting groove 340 and the predetermined one pair of through-holes 31*h* and 31*h* are made to be in communication, and one pair of first grooves 343 and 343 into which one pair of first contact pieces 353 and 353 are inserted is established. In addition, on the housing 34, a second groove 344 is established which opens to an outer wall of the housing 34, which is in communication with the press-fitting groove 340 and is made so that a second contact piece 354 can be inserted into the second groove 344. As a result, on the housing 34, the short circuit terminal 35 can be inserted into what is actually a bifurcate groove, formed by the one pair of first grooves 343 and 343, the press-fitting groove 340, and the second groove 344.

The operation and effects of the IC card according to the second embodiment of the present invention are the same as the operation and effects of the IC card according to the above-described first embodiment. Furthermore, in reference to FIGS. 8 through 10, for the IC card according to the second embodiment of the present invention, it is possible to pre-insert a short circuit terminal 35 into a pole for which a ground connection is required, and to insert a plurality of male connections 32 together. That is to say, automatic mounting of the male contacts 32 is possible. In this manner, the IC card according to the second embodiment of the present invention can be easily constructed, and one pair of poles can be ground connected by one short circuit terminal 35.

Heretofore, according to the present invention, a connector pin (contact) and a ground pin can be configured as a plate contact (a plurality of male contacts) that extends in a band, so as to configure a common "linkage-type contact," thus facilitating manufacture. Moreover, with the short circuit terminal mounted on the housing, it is possible to realize an IC card for which electrostatic countermeasures have been applied. As a result, it is possible to contribute to lowering the manufacturing cost of an IC card.

What is claimed is:

1. An IC card comprising:

a frame of a rectangular border-shape that is open on one side thereof;

a printed circuit board that is disposed on an interior portion of the frame and equips an electronic component;

a connector of a plate shape that constitutes one side of the frame; and one pair of shell plates having conductivity that covers the frame from both faces and constitutes an outer shell, wherein the connector includes:

a housing that has both faces thereof covered by the one pair of shell plates, a plurality of male contacts that is arranged in parallel in an interior of the housing, has one end portion that is a connecting portion to an external terminal, and has another end portion that is connected to the printed circuit board, and at least one short circuit terminal that is mounted on the housing, has one end portion thereof that contacts an intermediate portion of a predetermined male contact among the plurality of male contacts, and has another end portion thereof that contacts an inner wall of any one of the shell plates of the one pair of shell plates.

2. The IC card according to claim 1, wherein the short circuit terminal has:

a press-fit plate that press-fits into the housing to be substantially parallel to a direction of extension of the male contact;

a first contact piece that bends one single wing of the press-fit plate, and has a front portion thereof that contacts an intermediate portion of the male contact; and a second contact piece that bends another single wing of the press-fit plate, and has a front portion thereof that contacts an inner wall of either one of the shell plates of the one pair of shell plates.

3. The IC card according to claim 1, wherein the short circuit terminal has one end portion that contacts each intermediate portion of one predetermined set of male contacts which are adjacent to each other among the plurality of male contacts, and has another end portion that contacts an inner wall of either one of the shell plates of the one pair of shell plates.

4. The IC card according to claim 3, wherein the short circuit terminal has:

a press-fit plate that press-fits into the housing to be substantially parallel to a direction of extension of the male contact;

one pair of first contact pieces that bend both wings of the press-fit plate, and has front portions thereof that contact an intermediate portion of a set of the male contacts, which are adjacent to each other; and a second contact piece that inverts one end edge of the second press-fit plate into a J shape, and has a front portion that elastically contacts an inner wall of either one of the shell plates of the one pair of shell plates.

* * * * *